US012054897B2

(12) United States Patent
Morris

(10) Patent No.: US 12,054,897 B2
(45) Date of Patent: Aug. 6, 2024

(54) BOOM GATE

(71) Applicant: Traffic Tech Pty Ltd, Brookvale (AU)

(72) Inventor: James Morris, Brookvale (AU)

( * ) Notice: Subject to any disclaimer, the term of this patent is extended or adjusted under 35 U.S.C. 154(b) by 0 days.

(21) Appl. No.: 17/861,071

(22) Filed: Jul. 8, 2022

(65) Prior Publication Data

US 2023/0011541 A1 Jan. 12, 2023

(30) Foreign Application Priority Data

Jul. 9, 2021 (AU) ..... 2021902101

(51) Int. Cl.
*E01F 13/00* (2006.01)
*E01F 13/06* (2006.01)

(52) U.S. Cl.
CPC ..... *E01F 13/06* (2013.01)

(58) Field of Classification Search
CPC ..... E01F 13/06
See application file for complete search history.

(56) References Cited

U.S. PATENT DOCUMENTS 4,811,516 A * 3/1989 Anderson ..... E01F 13/06 49/141
5,720,132 A * 2/1998 Renner ..... E06B 11/04 49/273
2008/0085149 A1* 4/2008 Gamache ..... E01F 13/06 403/53
2021/0293089 A1* 9/2021 Shebib Loiselle .... E06B 11/022

* cited by examiner

*Primary Examiner* — Daniel J Troy
*Assistant Examiner* — Daniel Alvarez
(74) *Attorney, Agent, or Firm* — Fennemore Craig, PC

(57) ABSTRACT

The present invention relates to a boom gate including a boom gate body having a first end mounted to a pivot mechanism and a second end and a controlled failure region, wherein the boom gate body comprises at least one hollow tube being substantially comprised of carbon fibre or a derivative thereof, and the controlled failure region enables the boom gate to undergo controlled failure upon receiving a high-speed impact.

14 Claims, 4 Drawing Sheets

BOOM GATE

TECHNICAL FIELD

The present invention relates generally to the field of traffic control systems and in particular to deployable barriers such as boom gates.

BACKGROUND

Boom gates are typically used to temporarily block off access to one or more lanes on a road, such as a highway. In civilian usage, it is preferable that the boom gate be designed to be lightweight and safe, so that if it is impacted by a vehicle, the vehicle is not overly damaged and the occupants are not at risk.

Prior art 'safe' boom gates are often constructed of plastic, which is lightweight, but susceptible to UV damage. Plastics also have limited internal strength and so require additional reinforcement to be rigid enough to act as a gate, increasing the weight and thus the cost. Without this reinforcement, plastic boom gates tend to flex and bend under wind load, reducing their visibility and also inducing internal strain, leading to increased wear and tear. High wind load can cause a plastic boom gate to fail outright, which can pose an 'airborne missile' risk to surrounding people, vehicles and structures.

There is therefore a need for a boom gate providing improved safety measures as well as improved longevity and structural rigidity.

DISCLOSURE OF THE INVENTION

In a first aspect, the present invention relates to a boom gate including a boom gate body having a first end mounted to a pivot mechanism and a second end and a controlled failure region, wherein the boom gate body comprises at least one hollow tube being substantially comprised of carbon fibre or a derivative thereof, and the controlled failure region enables the boom gate to undergo controlled failure upon receiving a high-speed impact.

In an embodiment the controlled failure region is located within the boom gate body, and controlled failure comprises a portion of the boom gate body extending between the controlled failure region and the second end detaching from a remaining portion of the boom gate body.

In an embodiment the controlled failure region comprises at least one notch, groove, aperture or other form of controlled weakening means in the at least one hollow tube.

In an embodiment at least one hollow tube is formed of a plurality of hollow tube segments connected in series.

In an embodiment the boom gate body comprises at least two hollow tubes, being a first and a second hollow tube extending in substantially similar directions to one another and arranged side-by-side.

In an embodiment the boom gate body comprises at least three hollow tubes, such that a third hollow tube extends in a substantially similar direction to the first and the second hollow tubes, wherein a respective first end of the first, second and third hollow tubes are arranged in a triangle.

In an embodiment the first and second hollow tubes extend from the first end to the second end of the boom gate body, and the third hollow tube extends to a transition point partway along a length of the boom gate body.

In an alternative embodiment the boom gate body comprises at least five hollow tubes, the first, second and third hollow tubes arranged to form a first body portion extending from the first end to a transition point partway along a length of the boom gate body, and a fourth and a fifth hollow tube arranged to form a second body portion extending in substantially similar directions to one another from the transition point to the second end.

In an embodiment the first and second hollow tubes extend substantially parallel to one another.

In an alternative embodiment the first and second hollow tubes are arranged such that a width of the boom gate body gradually tapers.

In an embodiment there is at least one support structure extending between the first and the second hollow tube.

In an embodiment the first end of the boom gate body is mounted the pivot mechanism by at least an upper bolt and a lower bolt, the upper bolt being configured to provide a pivot point about a long axis thereof and to resist shear failure, and the lower bolt being configured to undergo shear failure upon the boom gate body receiving a high-speed impact, wherein, upon the boom gate body receiving a high-speed impact and the lower bolt undergoing shear failure, the boom gate body is able to pivot about the upper bolt.

In an embodiment the pivot mechanism comprises a pivot shaft about which the boom gate body pivots, and a drive mechanism engaged with the pivot axis and configured to induce pivoting of the boom gate body about the pivot axis, wherein engagement of the drive mechanism with the pivot axis inhibits pivoting of the boom gate body by external forces, and at least one of a wind having a velocity greater than a threshold velocity acting upon the boom gate body and a high-speed impact induces at least partial disengagement of the drive mechanism from the pivot axis.

In an embodiment partial disengagement of the drive mechanism enables the boom gate body to freely pivot from a deployed position to an undeployed position, and the drive mechanism is further configured such that, following the boom gate freely pivoting to an undeployed position, the boom gate body undergoes controlled return pivoting to the deployed position.

In an embodiment, the boom gate further comprises a flexible and/or padded cover on at least a portion of the boom gate body.

In an embodiment, the boom gate body further comprises a tether extending along the at least one hollow tube.

In an embodiment, the boom gate further comprises an indicator flag extending from the second end of the boom gate body.

Further embodiments may be disclosed herein or become apparent to the skilled person through the disclosure herein. These further embodiments are considered to also fall within the scope of the invention.

DESCRIPTION OF FIGURES

Embodiments of the present invention will now be described in relation to figures, wherein.

DETAILED DESCRIPTION OF PREFERRED EMBODIMENTS

Figure 1:
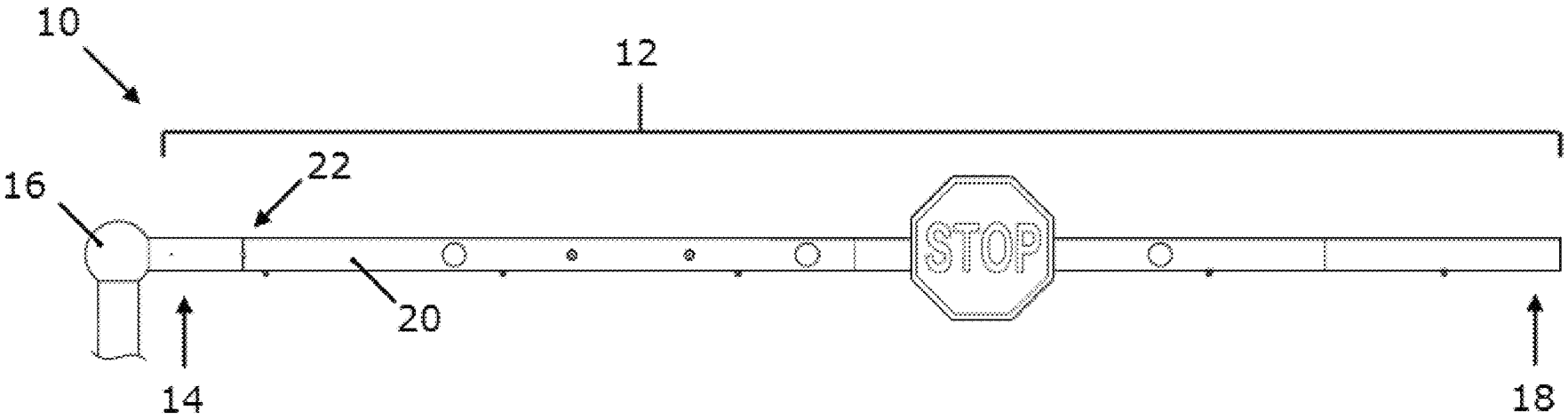
FIG. 1 depicts an embodiment of a boom gate of the present invention.

In one embodiment and with reference to FIG. 1, the present invention may comprise a boom gate 10 including a boom gate body 12 having a first end 14 mounted to a pivot mechanism 16, and a second end 18 that is distal from the first end, the boom gate body 12 comprising at least one hollow tube 20 being substantially comprised of carbon fibre or a derivative thereof. The boom gate 10 may further comprise a controlled failure region 22 that is positioned at a distance along the boom gate body 12 that is configured, shaped, adapted or otherwise arranged to enable the boom gate 10 to undergo controlled failure upon receiving a vehicular impact, said controlled failure being a failure of at least a component of the boom gate in such a way that the vehicle is undamaged by the boom gate, or damage to the vehicle by the boom gate is otherwise minimised.

As used herein, vehicular impact refers to an impact by a vehicle at speeds of up to 100 km/hr.

Carbon fibre is considered to be a particularly suitable material for embodiments of the boom gate body 12, due to it having a very low density (1.75-2.00 g/cm$^3$), as well as significant internal strength (3-7 GPa) and an extremely high modulus of elasticity (~225 GPa), resulting in a lightweight but incredibly stiff and strong material.

The Controlled Failure Region

As embodiments of the present invention are intended to visually inhibit use of a particular highway lane (as opposed to physically inhibit access), and are intended for use in civilian road situations, it is imperative that injuries to drivers and passengers of vehicles by the boom gate body 12 are ameliorated as much as possible. Similarly, damage to a vehicle travelling at high speeds is dangerous not only to the occupants of said vehicle, but also to nearby vehicles, pedestrians and structures due to the driver being surprised or distracted, loss of control (or loss of ability to control), and other effects that may occur due to sudden damage to a moving vehicle. It is therefore considered advantageous to provide means of safely inducing failure in the boom gate 10.

It is considered that a controlled failure region 22 may serve to provide at least one mechanism for controlling the release and expenditure of kinetic energy induced in the boom gate body 12 by a vehicular impact. This may inhibit, prevent or at least ameliorate the kinetic energy being returned to the vehicle that impacted said boom gate body, and therefore may inhibit or at least substantially reduce damage being done to said vehicle. In particular, a controlled failure mechanism may inhibit or at least ameliorate damage done to the vehicle's windscreen by the boom gate body, thereby ameliorating or preventing the vehicle operator's vision being occluded as well as broken glass or other debris being directed into the vehicle cabin.

FIG. 1 denotes the controlled failure region 22 as being within the boom gate body 12. However, the skilled person will appreciate that this is exemplary only. In various embodiments that are discussed further below, the controlled failure region 22 may be within the boom gate body 12, within the pivot mechanism 16, or at the connection site between the pivot mechanism 16 and the boom gate body 12. Embodiments of the present invention may comprise one, several or all of the various mechanisms of controlled failure disclosed herein without departing from the scope of the invention.

The Boom Gate Body

In one embodiment, 'controlled failure' may comprise a portion of the boom gate body 12 that is between the controlled failure region 22 and the second end 18 detaching from a remaining portion of the boom gate body. In such an embodiment, the controlled failure region 22 is shaped, configured or otherwise arranged to ensure that, upon the boom gate 10 receiving a vehicular impact to the boom gate body 12, the region distal of the controlled failure region 22 breaks off in an expected and controlled manner. It is considered that by providing a controlled failure region 22, the boom gate 10 is able to be designed and configured to break apart in a particular manner upon being hit by a vehicle travelling at high speeds. The exact configuration of the controlled failure region may be affected by environmental factors such as typical vehicles and vehicle speeds encountering the boom gate 10.

In at least one further embodiment, the controlled failure region 22 may provide a preferential 'breaking' site that is engineered to break, snap or otherwise detach a portion of the boom gate body 12 from the remainder at a lower impact force than other portions of the boom gate 10. By way of non-limiting example, the controlled failure region 22 may comprise at least one notch, groove, aperture or other form of controlled weakening means in the at least one hollow tube. In particular, controlled weakening sites may provide a preferred initiation site for fractures to extend outwards through the boom gate body 12. In contrast, an impact to a boom gate body without any form of controlled failure region 22 may have fractures begin at any point along the body and propagate in an uncontrolled, unpredictable manner.

In some embodiments, the hollow tube 20 may be formed of a plurality of hollow tube segments connected together in series. The hollow tube segments may be connected through any conventional means known in the art without departing from the scope of the invention.

Figure 2:
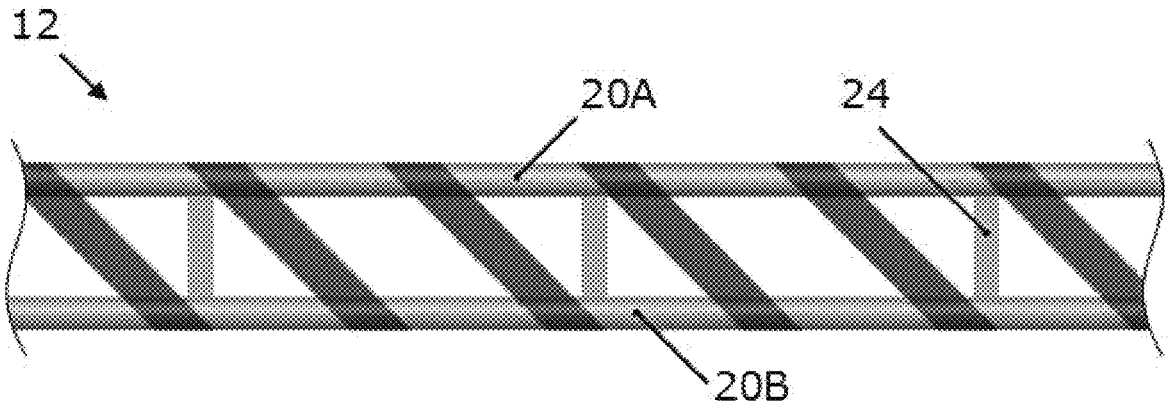
FIGS. 2 & 3 depict portions of an embodiment of a boom gate body.

With reference to FIG. 2, in an embodiment, the boom gate body 12 may comprise at least two hollow tubes arranged side-by-side, with the first hollow tube 20A and the second hollow tube 20B extending in substantially similar directions to one another. It is considered that providing two side-by-side hollow tubes 20A, 20B may provide improved structural strength within the boom gate body 12, enabling the body to have increased length. This may be beneficial in applications wherein multiple lanes of a road are to be blocked off by the boom gate 10. An aligned pair of hollow tubes 20A, 20B may enable the boom gate body 12 to have a length of at least six metres.

Figure 3:
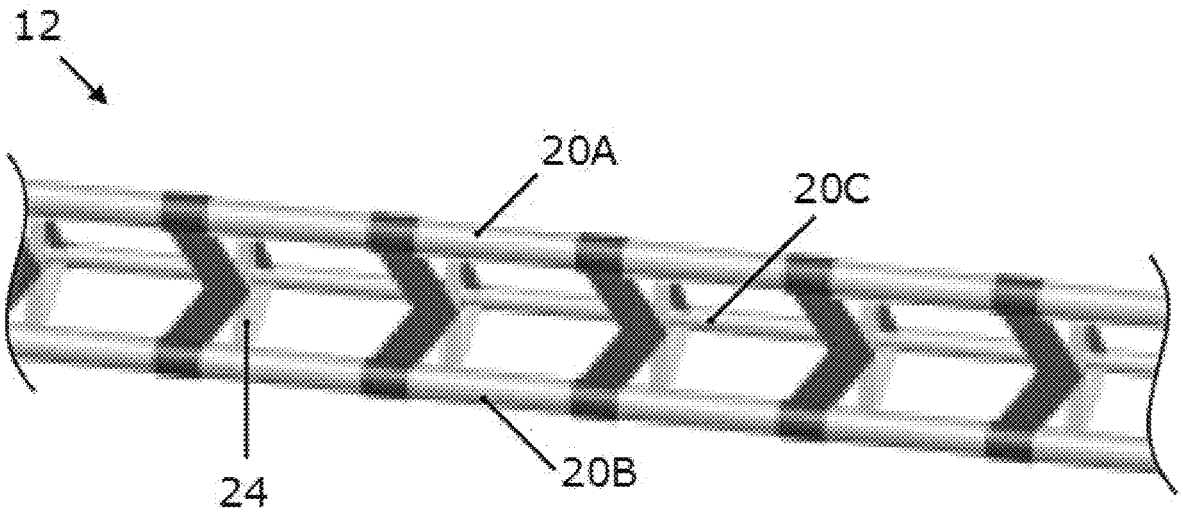

In a further embodiment of the invention and with reference to FIG. 3, the boom gate body 12 may comprise at least three hollow tubes, such that a third hollow tube 20C extends in a substantially similar direction to the first and the second hollow tubes 20A, 20B. In such an embodiment, the hollow tubes are arranged such that their respective first ends form a triangle. It is considered that with a third hollow tube 20C, the boom gate body 12 may be able to extend for an additional ten metres.

In some embodiments wherein the boom gate body 12 comprises at least two hollow tubes, the first and second hollow tubes 20A, 20B may extend substantially parallel to one another. In alternate embodiments, the first and second hollow tubes 20A, 20B may be arranged such that a width of the boom gate body 12 gradually tapers from the first end 14 to the second end 18, or vice-versa. These embodiments are considered to still comprise first and second hollow tubes 20A, 20B extending in 'substantially similar directions'.

With reference to FIGS. 2 & 3, in some embodiments, there may be at least one support structure 24 extending between the first hollow tube 20A and the second hollow tube 20B. In embodiments comprising three or more hollow tubes, there may be additional support structures 24 extending between any two of the hollow tubes. One advantage of carbon fibre is that the material is particularly strong. As a result, it is considered that in an advantageous arrangement, support structures 24 may be spaced approximately 1 metre apart without substantially damaging the rigidity of the boom gate body 12. At such a spacing, the boom gate 10 may be able to withstand high wind loads, due to the widely-spaced support structures minimising the surface area of the boom gate.

It is considered that in at least one advantageous arrangement, a one-metre spacing of support structures 24 may enable the boom gate to withstand high wind loads, such as wind speeds in excess of 100 km/h, and in one further advantageous embodiment, to withstand wind loads of up to approximately 150 km/hr. A more 'dense' spacing of support structures 24 may reduce the maximum wind load, but may improve visibility of the boom gate body 12 and may provide additional surfaces upon which to place reflective material, signage or other indicators.

Figure 4A:
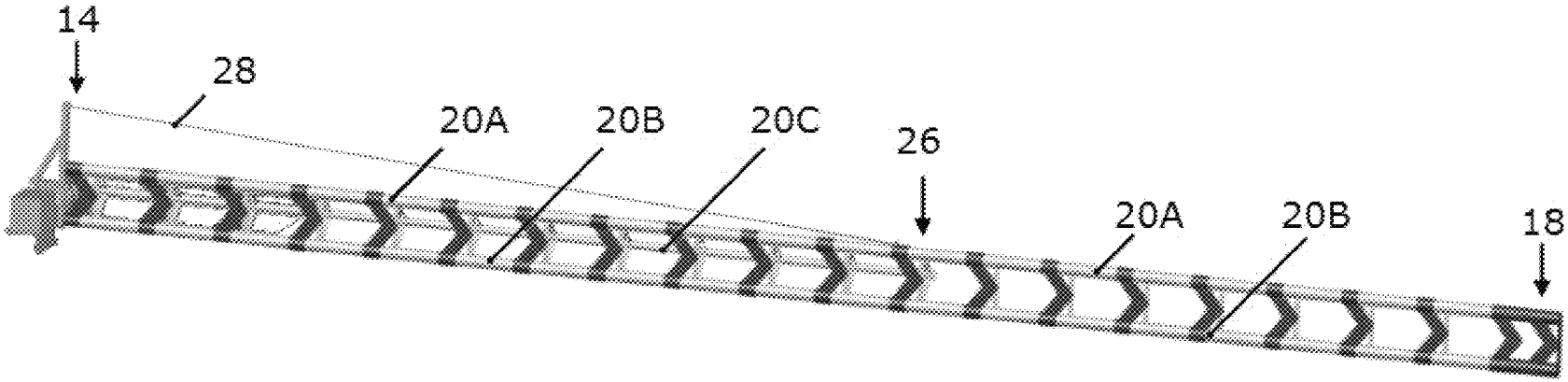
FIGS. 4A & 4B depict embodiments of a boom gate configured for greater lengths.
Figure 4B:
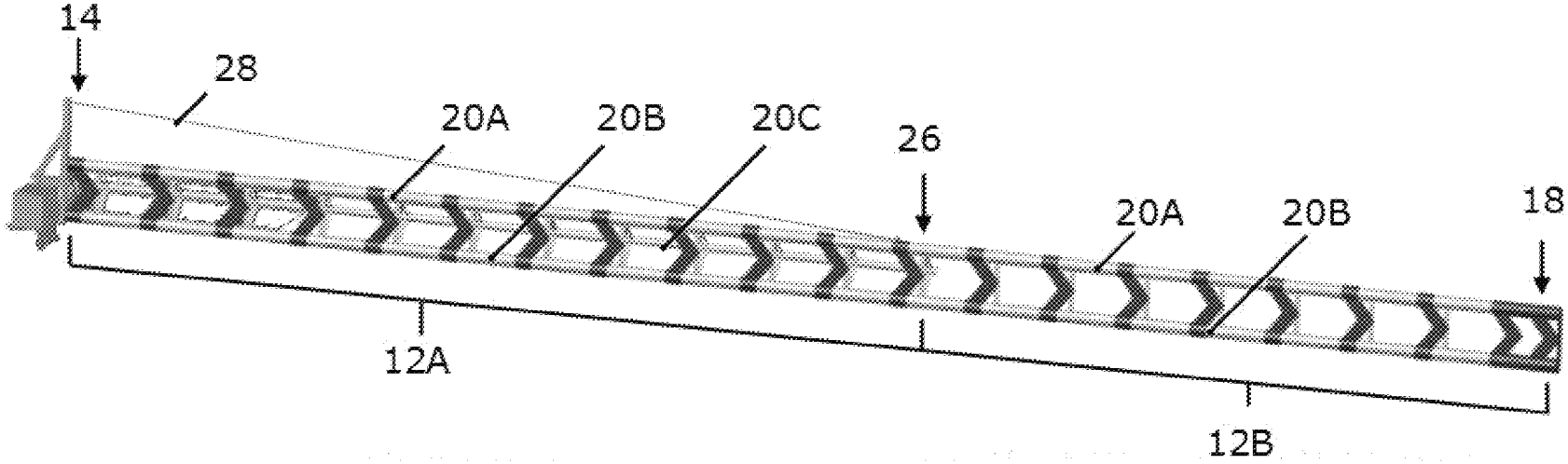

In one embodiment and with reference to FIG. 4A, the boom gate body 12 may comprise three hollow tubes 20A-C. The first and second hollow tubes 20A, 20B may extend substantially from the first end 14 to the second end. The third hollow tube 20C extends from the first end to a transition point 26 partway along the length of the boom gate body 12. In an alternate embodiment and with reference to FIG. 4B, the boom gate body may comprise five hollow tubes 20A-E, wherein the first, second and third hollow tubes 20A-C are arranged in a triangular shape and form a first body portion 12A extending from the first end 14 to a transition point 26, and the fourth and fifth hollow tubes 20D, 20E form a second body portion 12B extending from the transition point 26 to the second end 18. It is considered that either embodiment may enable a boom gate body to extend for lengths of at least 10 metres, with the third hollow tube 20C providing reinforcing for a portion of the length of the boom gate body 12 that is most susceptible to strain under the boom gate body 12 weight and other vertical forces.

At least one of the two hollow tubes 20A, 20B (or three hollow tubes 20A-C) may comprise a controlled failure region 22. In an alternate embodiment, the controlled failure region may be a separate component of the boom gate body 12, such as a connection point between the boom gate body and the pivot mechanism 16, or between sections of the boom gate body 12, that is configured to undergo controlled failure.

In some further embodiments, a cable 28 may run from the first end 14 to a point along the length of the boom gate body 12 to provide further resistance to sagging.

The Pivot Mechanism

Figure 5:
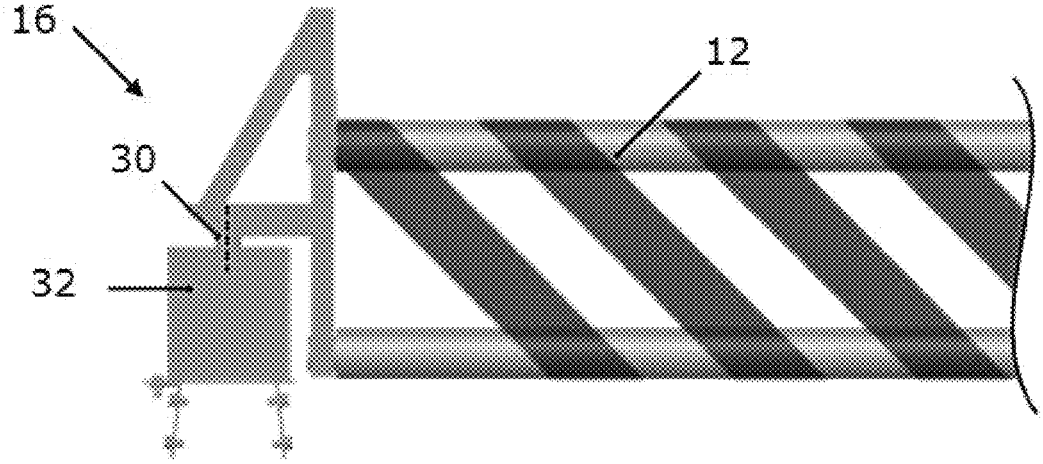
FIG. 5 depicts a pivoting end of an embodiment of a boom gate.

With reference to FIG. 5, in an embodiment, the pivot mechanism 16 comprises a pivot shaft 30 about which the boom gate body 12 is pivoted during opening or closing of the boom gate 10. In an embodiment, the controlled failure region 22 may located within the pivot mechanism 16. This may be in alternative to, or in addition to, any other described controlled failure regions.

In one such embodiment, the pivot mechanism 16 may further comprise a drive mechanism 32 that is engaged with the pivot shaft 30 which drives the boom gate body 12 to pivot about the pivot axis. In an embodiment, engagement of the drive mechanism 32 with the pivot shaft inhibits pivoting of the boom gate body 12 by external forces (such as wind, pedestrians, etc), such that the boom gate 10 cannot be manually opened from a closed position (or vice versa). In such an embodiment, the drive mechanism 32 and/or pivot shaft 30 may be configured such that a vehicular impact to the boom gate body 12, or wind having a velocity above a predetermined threshold velocity acting upon the boom gate body 12, induces at least partial disengagement between the drive mechanism 32 and pivot shaft 30. In such an embodiment, the boom gate body 12 may be freed to pivot about the pivot shaft 30. The boom gate body may be free in particular to pivot from a deployed position (protruding into traffic) towards an undeployed position (not protruding into traffic).

It is considered that providing a threshold above which partial disengagement is induced, allowing the boom gate body 12 to freely pivot, may provide a further failsafe mechanism. In the case of wind load above a threshold wind velocity, for example, the drive mechanism 32 may be configured to partially disengage (and thus release the pivot shaft 30 to enable free pivoting) at a wind velocity that is lower than the wind velocity that would otherwise damage the boom gate 10. This would mean that embodiments of the present invention may be deployable in locations susceptible to high winds without significant increase risk of damage to the boom gate body 12, or alternatively by a broken-off piece of the boom gate body being blown against a nearby structure, person or vehicle by said high-speed winds.

By way of further example, a vehicular impact by a vehicle may also serve to knock the boom gate body 12 aside, while lower-speed impacts—or other forces that may be those that a deployed boom gate 10 would be expected to be subject to on a daily basis, such as normal wind, vibrations, or people leaning on or pushing against the body 12—would not push the boom gate body 12 aside.

In a further embodiment, the drive mechanism 32 may partially disengage from the pivot shaft 30. In partial disengagement the boom gate body 12 may be able to freely pivot from a deployed position to an undeployed position, but would not be able to freely return to the deployed position. In such an embodiment, when the boom gate body 12 is pivoted to an undeployed position, it may subsequently undergo a controlled return pivoting to a deployed position. This may comprise powered return by the drive mechanism 32, or may alternatively comprise a return brake urging against the pivot shaft such that return pivoting occurs at a reduced speed.

The Connection

Figure 6:
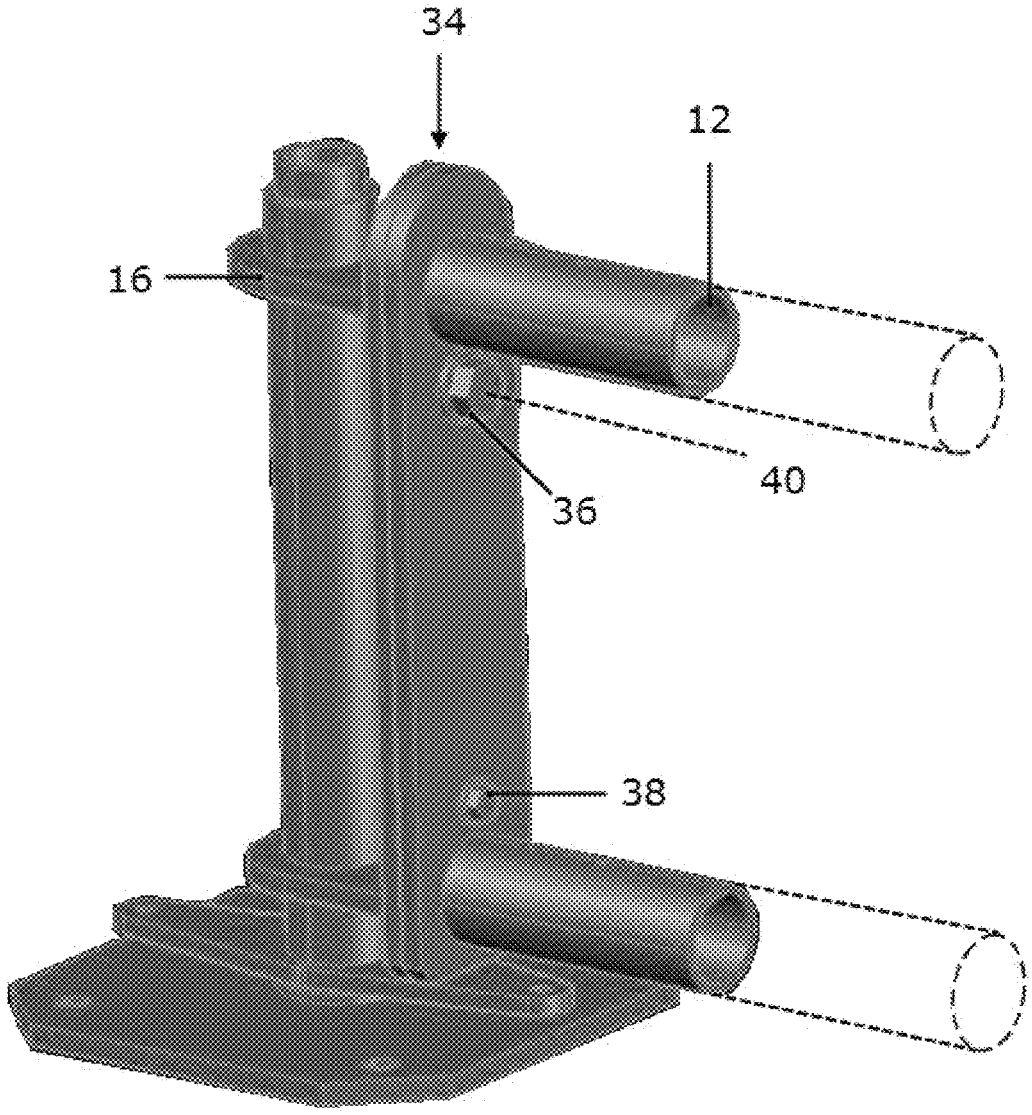
FIG. 6 depicts an embodiment of a boom gate pivot.

With reference to FIG. 6, in an embodiment, the controlled failure region 22 may be positioned at a connection point 34 between the boom gate body 12 and the pivot mechanism 16.

In one embodiment the boom gate body 12 may be connected to the pivot mechanism by at least an upper bolt 36 and a lower bolt 38. The upper bolt 36 may be configured to act as a pivot point about a long axis 40 of the upper bolt, and the lower bolt 38 may be configured to undergo shear failure upon the boom gate body 12 receiving a vehicular impact. In such an embodiment, upon the boom gate body 12 receiving an impact above a particular threshold, the lower bolt 38 may undergo shear failure, whereupon the boom gate body 12 is only connected to the pivot mechanism by the upper bolt 36. In such an arrangement, excess kinetic energy from the vehicular impact may induce the boom gate body 12 to rotate about the upper bolt 36 and long axis 40, thereby expending said kinetic energy. It is considered that providing an alternate means of expending kinetic energy induced in the boom gate body 12 by a vehicular impact may prevent, inhibit or at least ameliorate damage to the vehicle that impacted said boom gate body.

Further Variations

In an embodiment, the boom gate body 12 may further comprise a tether extending along at least a portion of the hollow tube 20. The tether may extend along the inside of the hollow tube 20, or may be external thereto. This may ensure that, should a piece of the boom gate body 12 be broken off (either through operation of a controlled failure region 22, or otherwise) then the broken-off pieces are swung around, thereby limiting the spread of any further shards.

In an embodiment the boom gate 10 may further comprise an indicator flag extending from the second end 18 of the boom gate body 12. The indicator flag may be comprised of a resiliently flexible material, and may contain one or more indicator LEDs.

In some embodiments, the boom gate body 12 may have a flexible and/or padded cover on at least a portion thereof. The cover may act to contain any fragments following an impact, and may also serve to further cushion against impacts and inhibit or ameliorate damage to a vehicle.

While the invention has been described with reference to preferred embodiments above, it will be appreciated by those skilled in the art that it is not limited to those embodiments, but may be embodied in many other forms, variations and modifications other than those specifically described. The invention includes all such variation and modifications. The invention also includes all of the steps, features, components and/or devices referred to or indicated in the specification, individually or collectively and any and all combinations or any two or more of the steps or features.

In this specification, unless the context clearly indicates otherwise, the word "comprising" is not intended to have the exclusive meaning of the word such as "consisting only of", but rather has the non-exclusive meaning, in the sense of "including at least". The same applies, with corresponding grammatical changes, to other forms of the word such as "comprise", etc.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Any promises made in the present document should be understood to relate to some embodiments of the invention, and are not intended to be promises made about the invention in all embodiments. Where there are promises that are deemed to apply to all embodiments of the invention, the applicant/patentee reserves the right to later delete them from the description and they do not rely on these promises for the acceptance or subsequent grant of a patent in any country.

The invention claimed is:

1. A boom gate including:

a boom gate body having a first end mounted to a pivot mechanism and a second end; and a controlled failure region;

wherein the boom gate body comprises at least one hollow tube being substantially comprised of carbon fibre or a derivative thereof; and the controlled failure region enables the boom gate to undergo controlled failure upon receiving an impact wherein the boom gate body comprises at least a first hollow tube and a second hollow tube extending in substantially similar direction to one another and in a common plane, and wherein the boom gate body comprises a third hollow tube extending in a substantially similar direction to the first and the second hollow tubes, wherein the third hollow tube extends substantially outside of the common plane defined by the first and second hollow tubes, wherein the first, second and third hollow tubes are arranged to form a first body portion extending from the first end to a transition point partway along a length of the boom gate body; and wherein said boom gate further comprises a fourth and a fifth hollow tube arranged to form a second body portion extending in substantially similar directions to one another from the transition point to the second end.

2. The boom gate of claim 1 wherein the controlled failure region is located within the boom gate body; and controlled failure comprises a portion of the boom gate body extending between the controlled failure region and the second end detaching from a remaining portion of the boom gate body.

3. The boom gate of claim 1 wherein the controlled failure region comprises at least one notch, groove, aperture or other form of controlled weakening means in the at least one hollow tube.

4. The boom gate of claim 1, wherein the at least one hollow tube is formed of a plurality of hollow tube segments connected in series.

5. The boom gate of claim 1, wherein the first and second hollow tubes extend from the first end to the second end of the boom gate body; and the third hollow tube extends to a transition point partway along a length of the boom gate body.

6. The boom gate of claim 1, wherein the first and second hollow tubes extend substantially parallel to one another.

7. The boom gate of claim 1, wherein the first and second hollow tubes are arranged such that a width of the boom gate body gradually tapers.

8. The boom gate of claim 1, wherein there is at least one support structure extending between the first and the second hollow tubes.

9. The boom gate of claim 1, wherein the first end of the boom gate body is mounted to the pivot mechanism by at least an upper bolt and a lower bolt;

the upper bolt being configured to provide a pivot point about a long axis thereof and to resist shear failure; and the lower bolt being configured to undergo shear failure upon the boom gate body receiving the impact;

wherein, upon the boom gate body receiving the impact and the lower bolt undergoing shear failure, the boom gate body is able to pivot about the upper bolt.

10. The boom gate of claim 1, wherein the pivot mechanism comprises:

a pivot shaft about which the boom gate body pivots; and a drive mechanism engaged with the pivot axis and configured to induce pivoting of the boom gate body about the pivot axis;

further wherein engagement of the drive mechanism with the pivot axis inhibits pivoting of the boom gate body by external forces; and wherein the external forces include at least one of a wind having a velocity greater than a threshold velocity acting upon the boom gate body and the impact induces at least partial disengagement of the drive mechanism from the pivot axis.

11. The boom gate of claim 10, wherein partial disengagement of the drive mechanism enables the boom gate body to freely pivot from a deployed position to an undeployed position; and the drive mechanism is further configured such that, following the boom gate freely pivoting to an undeployed position, the boom gate body undergoes controlled return pivoting to the deployed position.

12. The boom gate of claim 1, further comprising a flexible and/or padded cover on at least a portion of the boom gate body.

13. The boom gate of claim 1, wherein the boom gate body further comprises a tether extending along the at least one hollow tube.

14. The boom gate of claim 1, further comprising an indicator flag extending from the second end of the boom gate body.

* * * * *